US005692548A

United States Patent [19]

Bouwers et al.

[11] Patent Number: 5,692,548

[45] Date of Patent: Dec. 2, 1997

[54] WOOD CHIPPER

[75] Inventors: John Tibbe Breimer Bouwers, Pella, Iowa; Thomas Alan Eggers, Yankton, S. Dak.

[73] Assignee: Vermeer Manufacturing Company, Pella, Iowa

[21] Appl. No.: 649,580

[22] Filed: May 17, 1996

[51] Int. Cl.[6] ..... B27L 11/00; B02C 18/18; B02C 23/04

[52] U.S. Cl. ..... 144/174; 144/162.1; 144/373; 144/172; 241/92; 241/101.74; 241/277; 241/278.1

[58] Field of Search ..... 144/162.1, 172, 144/173, 174, 373; 241/92, 93, 101.74, 101.76, 273.2, 273.3, 277, 278.1

[56] References Cited

U.S. PATENT DOCUMENTS 3,209,801 10/1965 Little et al. ..... 144/172
3,524,485 8/1970 Smith .
3,661,192 5/1972 Nicholson et al. .
3,861,602 1/1975 Smith .
3,907,016 9/1975 Nicholson et al. ..... 144/172
3,944,147 3/1976 Pletcher .
3,989,198 11/1976 Blasko .
4,009,837 3/1977 Schnyder ..... 241/93
4,057,192 11/1977 Smith .
4,135,563 1/1979 Maucher .
4,162,769 7/1979 LaPointe .
4,260,114 4/1981 Herder .
5,005,620 4/1991 Morey .

*Primary Examiner*—W. Donald Bray
*Attorney, Agent, or Firm*—Merchant, Gould, Smith, Edell, Welter & Schmidt, P.A.

[57] ABSTRACT

A drum chipper for chipping wood material includes a chipping drum having a blade mounted at an opening formed through a circumferential surface of the drum. The drum includes an internal conical surface positioned for a chip to flow radially inwardly from the blade towards the conical surface and outwardly through an axial face of the drum.

15 Claims, 6 Drawing Sheets

WOOD CHIPPER

BACKGROUND OF THE INVENTION

1. Field of the Invention

This invention pertains to wood chippers and more particularly to wood chippers having rotatable drums which carry blades on circumferential walls of the drums.

2. Description of the Prior Art

Wood chippers are well known to reduce trees, limbs, branches, bushes and the like to wood chips. Chippers come in a wide variety of sizes and power ratings to handle wood material of varying sizes.

In so-called "drum-type" chippers, the chipper includes a cylindrical drum which carries knives or blades on the circumferential wall of the drum. The drum is driven to rotate about its cylindrical axis at high rotational velocities—for example, 1050 revolutions per minute. Commonly, a drum is separated into two halves with a plurality of knives positioned on both first and second halves. For example, on each half, knives may be placed at 180° spacing. The knives in the first half are offset from knives in the second half by 90°. Therefore, four different knives are provided on the drum to chip at a log being fed towards the drum. Accordingly, the drum will make approximately 4,200 cuts per minute to produce numerous chips. The size of the chip can be varied by varying the position of the blade on the drum. An example of a drum chipper is shown in U.S. Pat. No. 5,005,620 to Morey dated Apr. 9, 1991.

An additional type of wood chipper is a so-called "disc-type" chipper where cutting knives are carried radially on the face of a spinning disc. An example of such a chipper is illustrated in U.S. Pat. No. 3,861,602 dated Jan. 21, 1975 to Smith.

In both drum-type and disc-type chippers, the chipper will include an inlet and an outlet. At the inlet, rollers or the like are provided to feed a log toward the knives. The outlet typically includes a discharge chute to receive chips and direct the chips in a controlled direction so that the chips may be accumulated for subsequent disposal.

In the design of chippers, it is desirable to avoid unnecessary power consumption. With increased efficient design of chippers, the feed rate of a log through a chipper can be increased to thereby increase the production capabilities of a chipper.

We have found that prior art chippers restrict the maximum feed rate of the chipper by reason of the unnatural path through which the produced chips must pass. For example, with reference to the aforementioned U.S. Pat. No. 5,005,620 (in particular, FIG. 7 of that patent), chips are formed on the leading edge of a knife and injected into a basket disposed beneath the knife. According to that patent, the chips accumulated in the basket are then discharged past a trailing edge of the knife. Even assuming this method of operation, it will be noted that in order for the chips to be discharged, the direction of the chips must be completely changed. Specifically, the chips are first projected radially inwardly into the drum and then ejected radially outward through the drum. Accordingly, the momentum of the chip must be stopped and reversed. Also, it is believed that chips do not necessarily follow the path described in the aforementioned patent but may become entrained within the basket thereby presenting an obstruction to chips being formed and urged into the baskets. Also, we believe that, in fact, in such a chipper, most chips continue to eject radially outwardly from the forward edge of the knife with only a small portion ejected past the trailing edge of the knife.

In drum chippers, the chipping action produces a large volume of minute debris such as wood dust and the like. This debris may accumulate within a chipping drum by reason of adherence of the debris to itself and to the walls of the drum. Excessive accumulation of such debris presents an obstruction to the free flow of chips through the drum which may further reduce the feed rate and productivity of the chipper.

It is an object of the present invention to provide a chipper in which chips are directed through an unobstructive pathway such that the chips do not interfere with one another and which avoids the accumulation of debris within the drum.

II. SUMMARY OF THE INVENTION

According to a preferred embodiment of the present invention, a chipper is provided having a frame with a material inlet and a chip outlet. An engine is mounted to drive a chipper member. The chipper member includes at least one blade mounted within the frame with the blade movable about a circumferential path of travel about an axis of rotation. The chipper member is positioned for the blade to chip material provided at the inlet of the frame and to form chips, at least some of which are projected in a generally radially inward path from the blade toward the axis of rotation. The chipping member further includes a deflection surface positioned for the inwardly projected chips to be deflected from the radial path to an axial path. The chip outlet is positioned to receive the chips from the axial path.

With this novel structure, chips are not retained within the chipping member such that the chips would otherwise interfere or obstruct the travel of newly formed chips. Instead, a chip is directed first radially inwardly into the chipping member and then axially outwardly from the chipping member. This and other features of the present invention to be more particularly described are found to provide a chipper which can have an increased feed rate and which reduces the accumulation of chipping debris within the chipping member.

III. BRIEF DESCRIPTION OF THE DRAWINGS

IV. DESCRIPTION OF THE PREFERRED EMBODIMENT

Referring now to the several drawing figures in which identical elements are numbered identically throughout, a description of the preferred embodiment of the present invention will now be provided.

Figure 1:
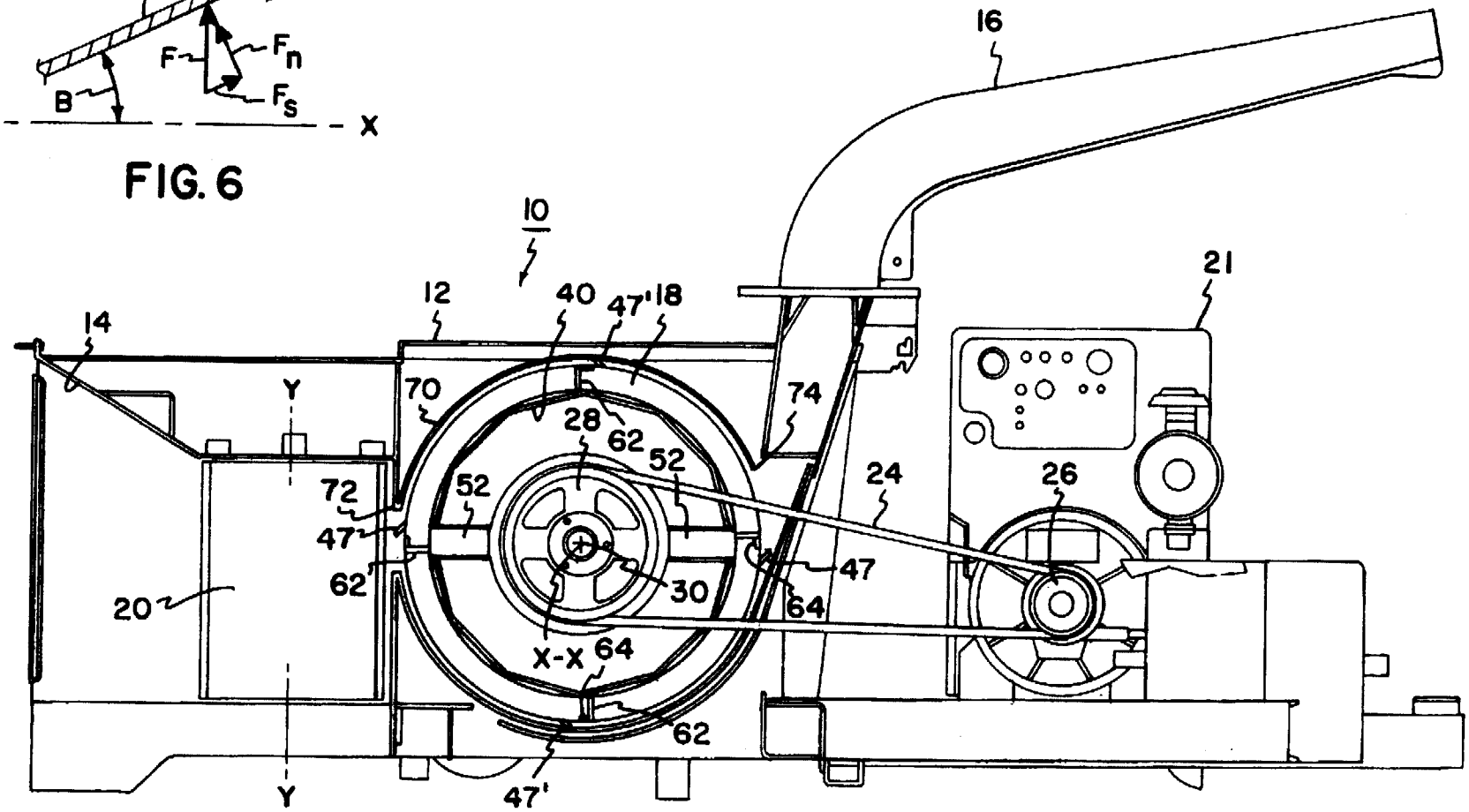
FIG. 1 is a side elevation view of a chipper according to the present invention with side walls removed to expose interior elements.

With initial reference to FIG. 1, a chipper 10 is shown with side walls removed to show interior elements. The chipper 10 includes a frame 12 (mounted on wheels—not shown) having an inlet 14 and an outlet 16. A novel chipping member in the form of a chipping drum 18 (as will be more fully described), is mounted within the frame 12 for rotation about an axis of rotation X—X. As is conventional, the drum 18 is mounted such that logs or other material admitted through inlet 14 are directed towards the drum 18 in a direction generally radial to the axis X—X. Also, as is conventional, rotating feed rollers (of which only one is shown at 20) are provided which rotate about a generally vertical axis Y—Y to receive logs or other material from the inlet 14. The feed rollers 20 are driven to direct and force the logs toward the rotating drum 18. An engine 22 is mounted on the frame 12 and coupled to the drum 18 by any suitable means to cause rotation of the drum about its axis X—X. In the embodiment shown in FIG. 1, a belt 24 is entrained around a drive pulley 26 mounted on an output of the engine 22. The belt 24 is further entrained around a driven pulley 28 mounted on a shaft 30 coupled to the drum 18. It will be appreciated that connections for driving drums and rotating drum chippers are well known.

Figure 2:
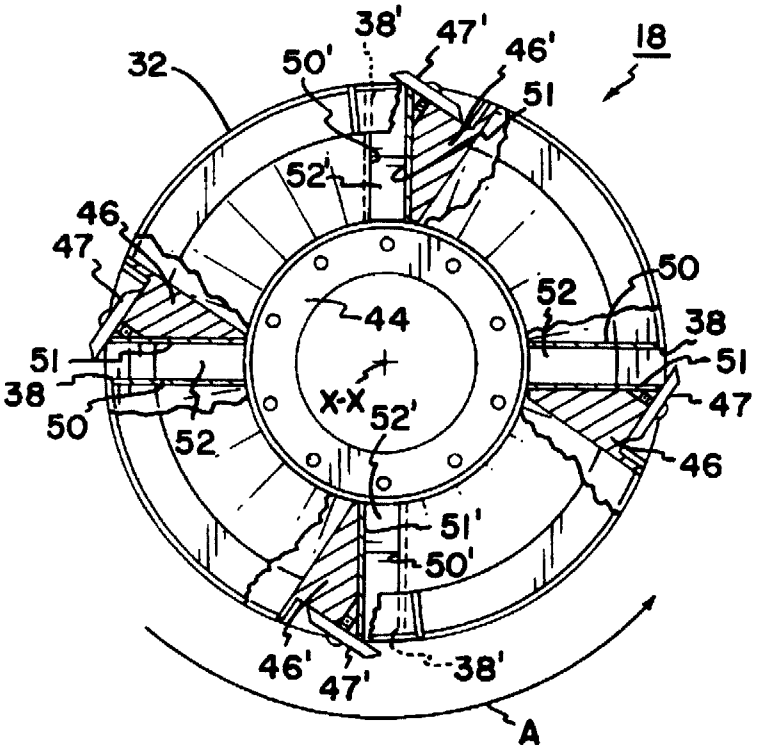
FIG. 2 is an end elevation view of a chipping drum (shown partially in section) for use in the chipper of FIG. 1.
Figure 3:
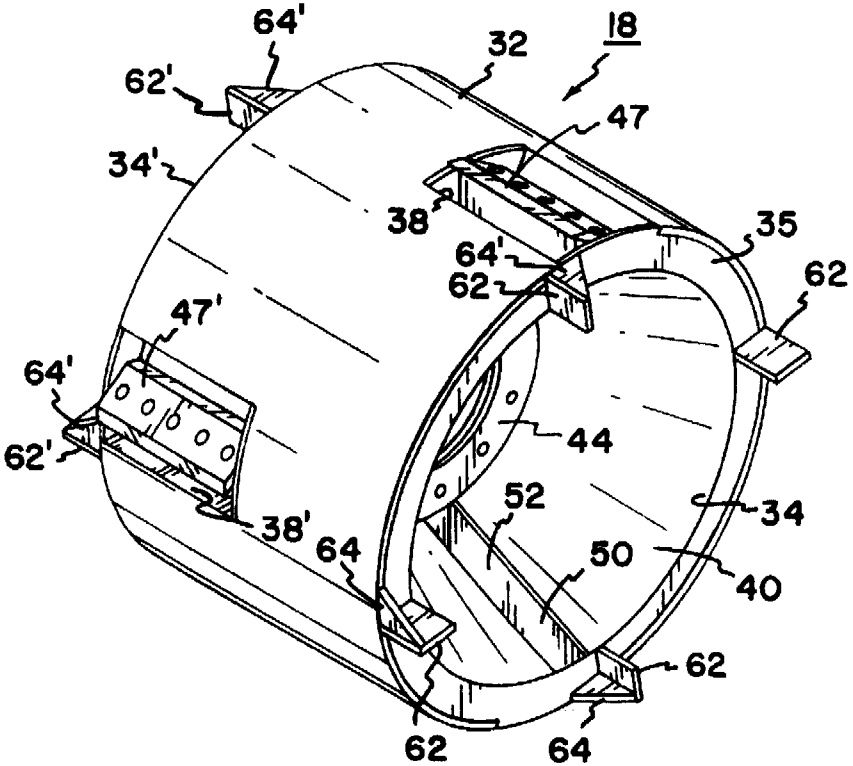
FIG. 3 is a perspective view of the drum of FIG. 2.
Figure 4:
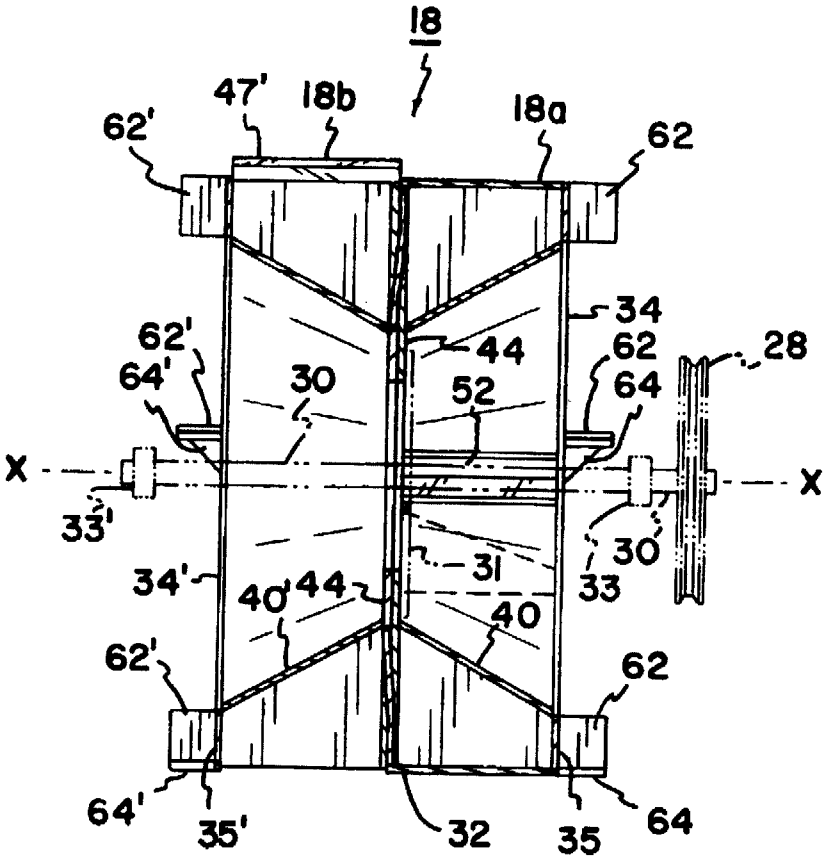
FIG. 4 is a side sectional view of the chipping drum of FIG. 2.

The present invention is principally directed to novel drum 18 and attention is now directed to FIGS. 2–4. The drum 18 is generally cylindrically and includes a circumferential surface 32 and a first axial end 34 and a second axial end 34' Annular rings 35,35' are provided at ends 34,34'.

The drum 18 includes a plurality of openings 38, 38' (see, FIG. 1) formed through the circumferential surface 32. As shown in FIG. 4, the drum includes a first half **18*a* and a second half 18*b*. The halves 18*a*, 18*b* are substantially symmetrical and similar elements are numbered identically with the elements on half 18*b* including the designating apostrophe "'" to distinguish from the elements on half 18*a*** which are otherwise numbered identically.

On first half **18*a*, two openings 38 are provided on diametrically opposed sides of the drum and offset by 180° (see, FIG. 2). Similarly, on drum half 18*b*, openings 38' are also provided 180° separated with the openings 38' offset from openings 38** by 90° relative to the axis of rotation X—X.

The drum 18 is hollow and contains two frustoconical surfaces 40,40'. For reasons that will be explained, the frusto-conical surfaces 40,40' are disposed at an angle of about 30° relative to the axis of rotation X—X. Surfaces 40,40' may be rolled steel to provide a smooth conical surface (FIG. 3) or may be bent steel to provide a segmented conical surface comprised of a plurality of flat surfaces (as illustrated in FIG. 1) or may be formed through any other suitable means.

The frusto-conical surfaces 40,40' are provided with their axes generally coaxial with the axis of rotation X—X. The frusto-conical surfaces 40,40' are further positioned with their major diameters at the annular rings 35,35' and with their minor diameters joined at separating center plates 44,44' (see FIG. 4). As shown in FIG. 4, the drum is supported by shaft 30 which has a flange 31 bolted to the center plates 44,44'. Bearings 33,33' support the shaft.

At each of the openings 38,38', blade mounting blocks 46,46' are provided such that a cutting blade or knife 47,47' can be secured to the blade mounting blocks 46,46'. As is typical, the blade mounting blocks 46,46' permit the knife 47,47' to be adjusted in its positioning on the blade mounting blocks 46,46' to permit the formation of smaller or larger chips as might be desired by an operator of the chipper 10. The use of such mounting blocks is not necessary to practice the present invention.

Interior plates 50, 51, 50', 51' (best shown in FIG. 2) are provided aligned with the openings 38,38'. The plates 50, 51, 50', 51' are generally parallel and spaced apart to define a pathway 52,52' from the openings 38,38' to the conical surfaces 40,40'.

Secured to the annular rings 35,35' are a plurality of discharge plates 62,62'. The plates 62,62' extend axially away from the mounting rings 35,35' with the plane of the plates 62,62' being radial to the axis of rotation X—X. In order to provide structural support for the plates 62,62', support gussets 64,64' are secured to each of the plates at right angles to the plates 62,62'.

With the structure thus described, as the drum 18 is rotated in direction A (FIG. 2), logs are fed by feed rollers 20 against the circumferential surface 32. The blades 47,47' engage the logs to cause chips to be cut off of the logs. The chips are forced through the action of the drum 18 through the openings 38,38' and into the pathways 52,52' defined between the plates 50, 51, 50',51'. The chips are then directed into the interior of the drum defined by the frusto-conical surfaces 40,40'. Within the interior of the drum, the chips impinge upon the frustoconical surfaces 40,40' which act as deflecting surfaces to deflect the chips outwardly from the drum in an axial path of travel through the axial faces 34,34'. Accordingly, it will be noted that a chip first moves in a general radially inward direction from the blades 37,37' to the axis of rotation X—X and then axially outward through the axial faces 34,34' of the drum 18.

Figure 5:
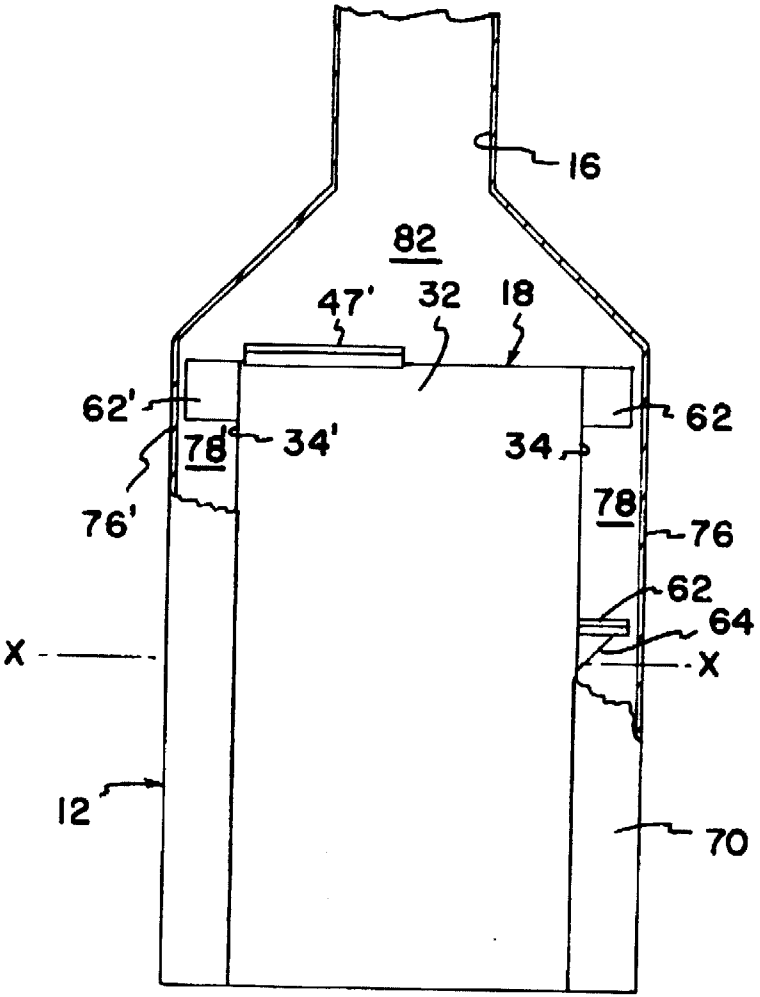
FIG. 5 is a top plan view of the chipping drum contained within a frame with covering material partially removed to show interior elements.

With reference now to FIGS. 1 and 5, the frame 12 includes arcuate sheathing 70 which substantially surrounds the circumferential surface 32 of the drum 18 but which is open at an inlet 72 and an outlet 74. Accordingly, the sheathing 70 does not interfere with the advancement of logs from feed rollers 20 to the drum 18. With reference to FIG. 5, at the axial faces 34,34', the sheathing 70 and side walls 76,76' cooperate to define discharge volumes 78,78' adjacent both axial faces 34,34' of the drum 18. The discharge volumes 78,78' are in particle flow communication with the entrance portion 82 of discharge chute 16. Therefore, as chips are axially expelled from the rotating drum 18, the discharge plates 62 force the expelled chips into the entrance portion 82 and out of the discharge chute 16.

As previously mentioned, the surface of the conical surfaces 40,40' are set an angle of about 30° to the axis X—X of rotation of the drum 18. More specifically, the angle of the conical surfaces are set to ensure that material on the conical surfaces 40,40' do not adhere to the conical surfaces 40,40' but instead is directed outwardly through the axial faces 34,34' of the drum 18.

Figure 6:
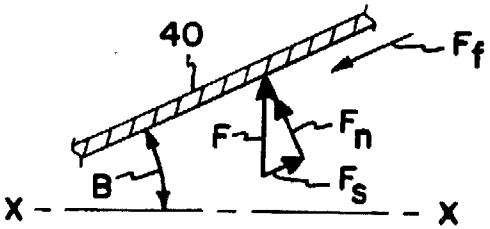
FIG. 6 is a diagrammatic representation of forces acting on a chip impinging on an interior deflection surface of the drum of FIG. 2.

FIG. 6 illustrates what is presently believed to be the physics of the interaction of chips on a conical surface 40. In FIG. 6, a portion of the conical surface 40 is shown relative to the axis X—X of rotation. Vector F illustrates the force at which a chip impinges upon the conical surface 40. This vector F includes both a normal component $F_n$ which is perpendicular to the surface 40 and a resultant shear component $F_s$. The shear vector $F_s$ represents the force acting on the chip causing it to move in a direction generally parallel to the wall of the conical surface 40 (i.e., in a desired path of travel which is axially out of the drum 18). Opposing the axial movement of the chip is a frictional force $F_f$. The frictional force is equal to the product of the normal force $F_n$ times the coefficient of friction of wood chips on the steel surface of the cone 40. In order to prevent adherence and accumulation of wood debris on the cone 40, the shear vector $F_s$ must be greater than the friction vector $F_f$. Through Applicant's calculations, if the angle B between the cone 40 and the axis X—X is about 30°, the shear force $F_s$ is about two or three times the frictional force $F_f$.

With the construction thus described, a chip is projected radially inwardly to the rotating drum 18. A chip may either bounce off of the cones 40,40' and be directed through the axial faces 34,34' of the drum or the chip may slide off of the wall of the cones 40,40' since the angle of the cones 40,40' relative to the axis X—X is selected for the shear force at the surface to be greater than the frictional force opposing the desired sliding motion. In tests, Applicants have noted that not all chips are projected radially inwardly. Instead, most formed chips are immediately ejected radially outwardly from the knives 47,47' at the leading edge of the knives. However, the presence of the pathways 52,52' to the conical surfaces 40,40' provides an alternative path for chips which would not otherwise exit radially and which would otherwise interfere with new chip formation. The result of the alternate pathway is a drum chipper having a much improved material feed rate.

Figure 10:
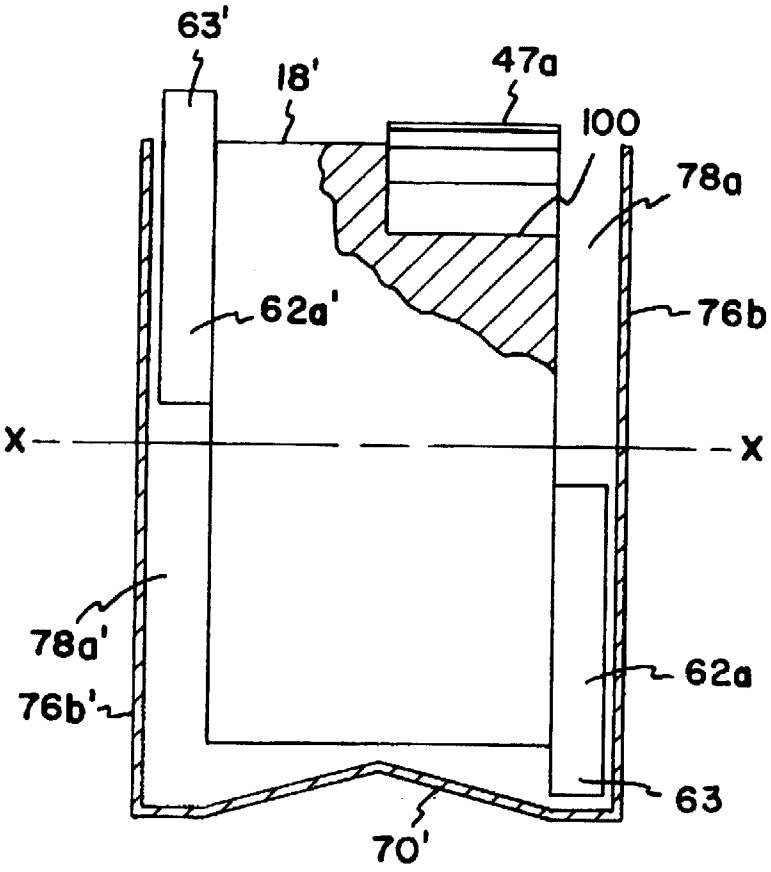
FIG. 10 is a top sectional view of the drum of FIG. 9.
Figure 9:
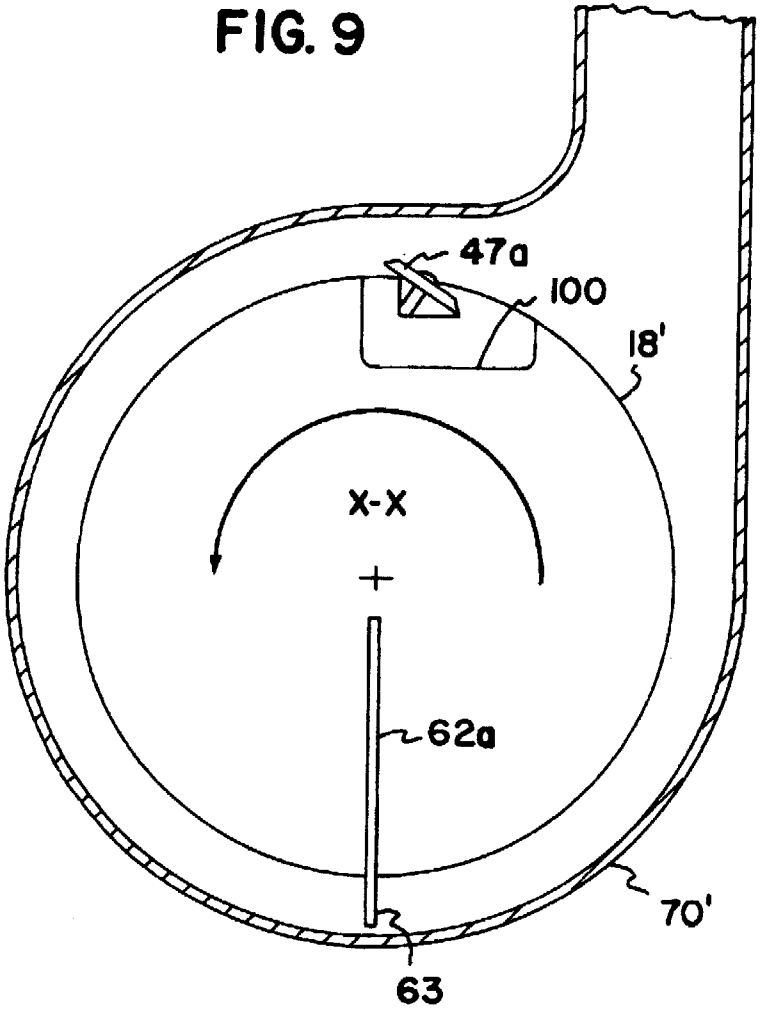
FIG. 9 is view similar to FIG. 7 showing an alternative embodiment.
Figure 11:
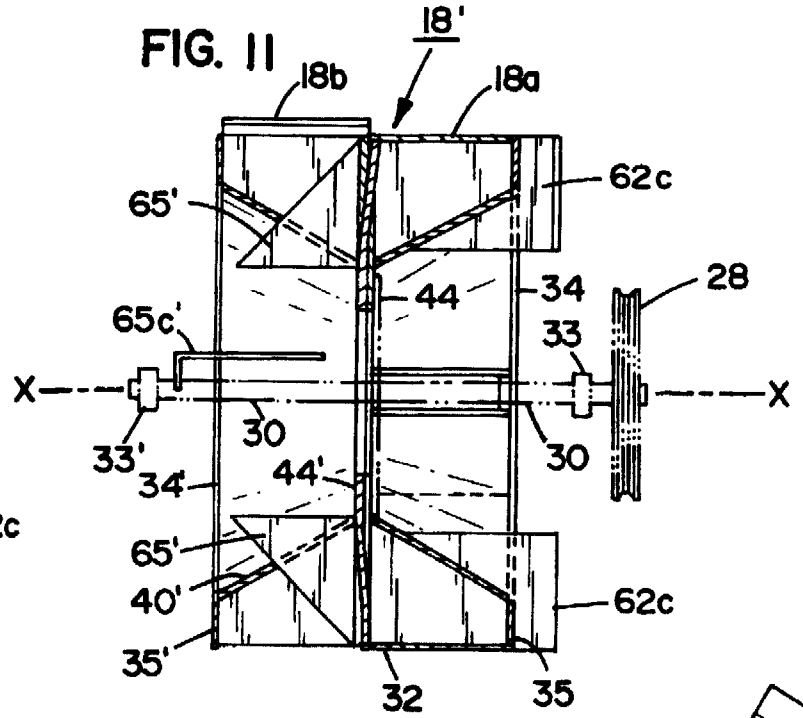
FIG. 11 is a side sectional view of an embodiment of a chipping drum.
Figure 12:
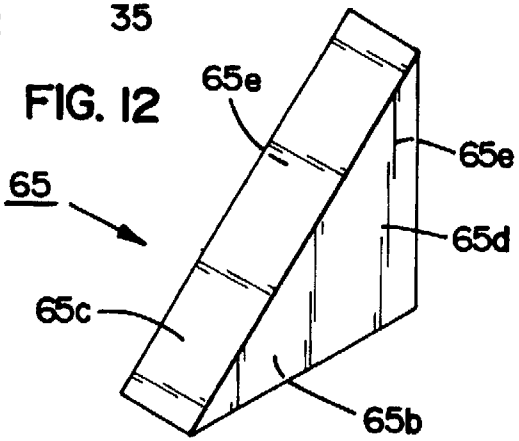
FIG. 12 is a perspective view of an element of FIG. 11.
Figure 13:
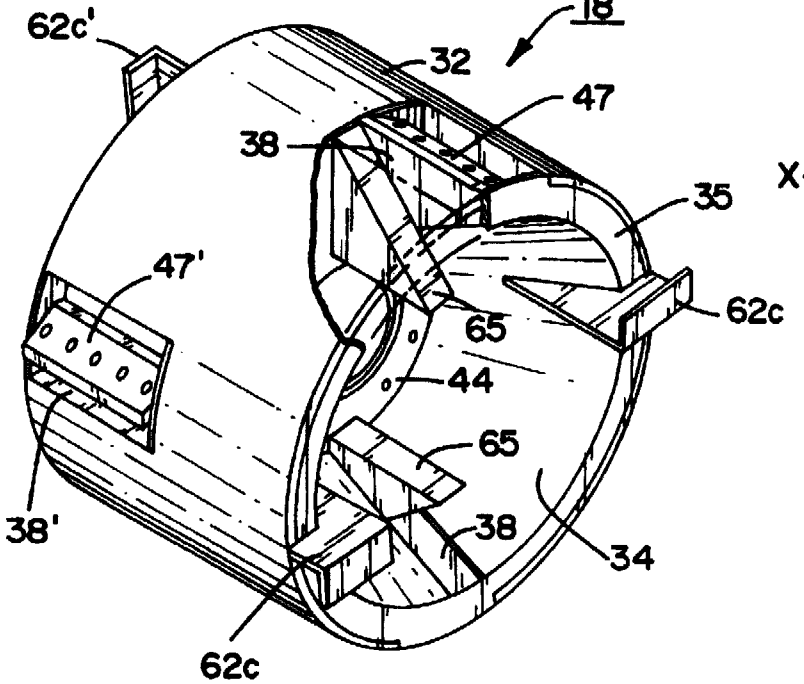
FIG. 13 is a perspective view of the embodiment of FIG. 11.

As previously discussed, chips are removed from the axial faces 34,34' of the drum 18 by reason of the rotating discharge plates 62,62'. FIGS. 9–10 illustrate an alternative design in a drum 18' where discharge plates **62*a*, 62*a*' are provided with their radial tips 63,63' spaced from the axis of rotation X—X a distance greater than the diameter of the drum 18' With this modified design, the tip speed of the discharge plates 62*a*, 62*a*' is increased. Therefore, greater kinetic energy is applied to the chips. As a result of the larger discharge plates 62*a*,62*a*', for any given drum speed, increased force is provided to remove the chips from the drum. Therefore, a drum can be slowed to increase the torque of the drum shaft and make the chipper quieter. Also, in FIGS. 9–10, the drum 18' is shown with a modified design where axial direction of a chip from blades 47*a* is achieved by providing solid drum 18' with a cut-out pocket 100 at the blades 47*a* in communication with side chambers 78*a*,78*a*' defined between frame sidewalls 76*a*,76*a*' and drum axial faces 34*a*,34*a*'. This defines a chip pathway 101 which has a radially inward portion and an axial outward portion. Also, circumferential frame 70' is V-shaped to define a clearance for enlarged plates 62*a*,62*a*' and to direct radially expelled chips to the plates 62*a*,62*a*'**.

Figure 8:
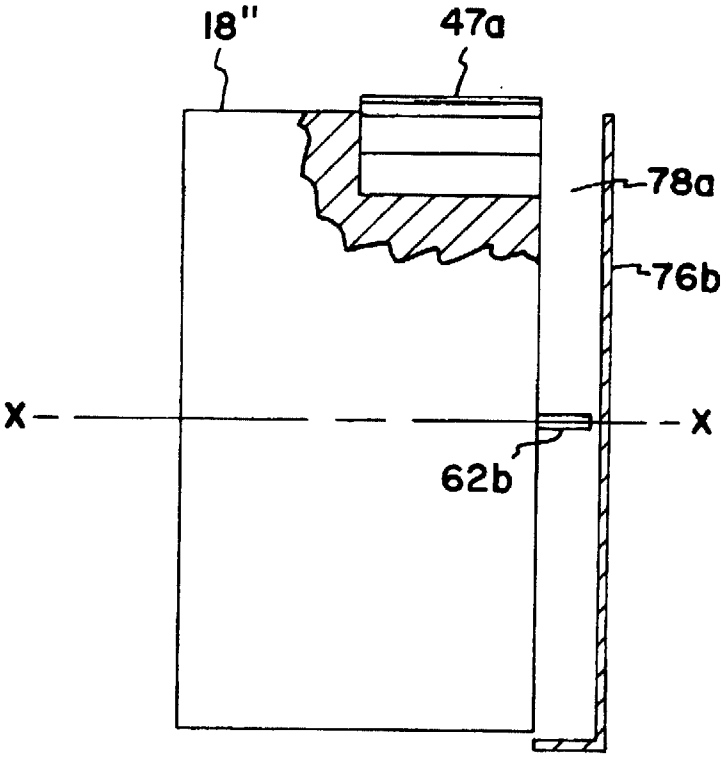
FIG. 8 is a top sectional view of the drum of FIG. 7.
Figure 7:
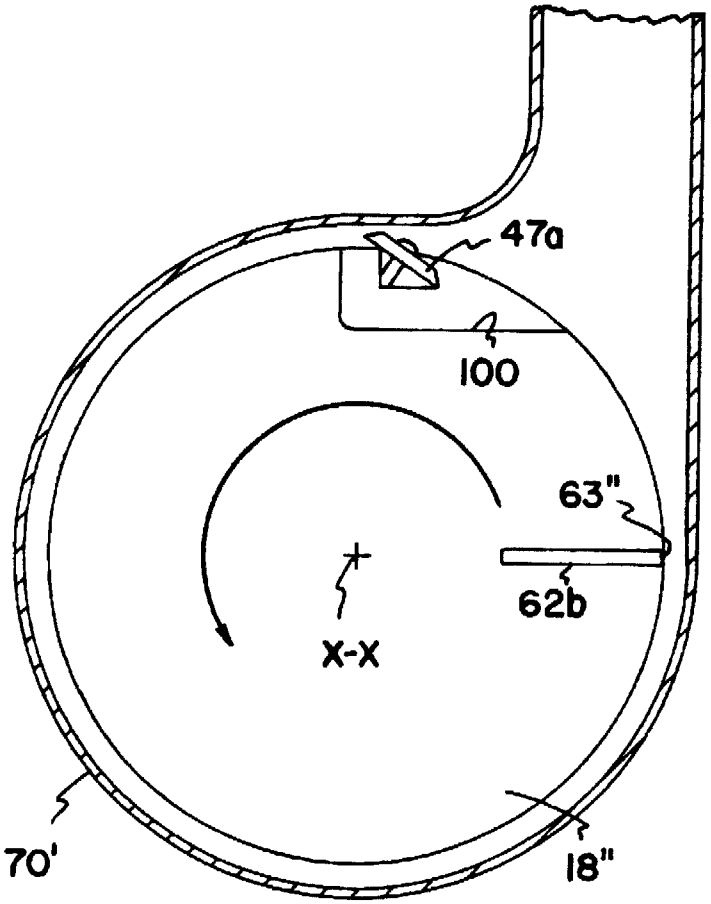
FIG. 7 is a side sectional view, shown in schematic form of an alternative chipping drum with axially positioned discharge plates.

The use of discharge plates 62 on the axial ends 34,34' of the drum 18 have been illustrated in the preferred embodiment with respect to novel drum 18. However, such plates could also be used with respect to drums such as that shown in U.S. Pat. No. 5,005,620 by simply providing a side path for chips to be directed from the cutting knives of the chipper to the paddles. FIGS. 7 and 8 illustrate such an embodiment where a pocket is formed behind the plates in a solid drum. In FIGS. 7 and 8, the drum 18" is similar to drum 18' in FIG. 9–10 except the discharge plates **62*b* in drum 18" are smaller than plates 62*a* in FIGS. 9–10. Plates 62*b* have a radially outer tip 63" spaced from axis X—X equal to the diameter of drum 18". In either of the embodiments of FIGS. 7–10, the chip path need not extend into the drum and then axially outward. Instead, a chip can be projected radially outward and then directed to the discharge plates 62*a*,62*b* by the shielding 70' to take advantage of the invention of the plates 62*a*,62*b***.

By reason of the foregoing structure, Applicants have achieved the obviousness of the invention in the form of an improved chipper with an improved feed rate. Further, accumulation of debris within the chipper drum is minimized.

Having disclosed the present invention in a preferred embodiment, it has been shown how the objects of the invention have been attained. However, modifications and equivalents of the disclosed concepts such as those which readily occur to one skilled in the art are intended to be included within the scope of the claims which are appended hereto.

What is claimed is:

1. A chipper for chipping wood material, said chipper comprising:

a frame having a material inlet and a chip outlet;

an engine;

a chipping member carried on said frame and including at least one blade mounted in said frame for travel in a circumferential path of travel about an axis of rotation;

said chipping member positioned for said blade to chip said material at said inlet to form chips and with said chips projected in a radial path generally radially inwardly from said blade toward said axis;

said chipping member connected to said engine for said engine to drive said chipping member for said blade to move in said path of travel;

said chipping member further including a deflection surface positioned for said chips to be deflected from said radial path to an axial path;

said chip outlet positioned to receive said chips from said axial path.

2. A chipper according to claim 1 wherein said chipping member includes a plurality of said blades circumferentially spaced about said axis of rotation.

3. A chipper according to claim 1 wherein said chipping member comprises a drum having a circumferential surface and at least a first axial face;

said circumferential surface including at least one opening formed therein with said blade positioned at said opening to form said chips at said opening with said chips passing through said opening in said radial path.

4. A chipper according to claim 1 wherein said deflection surface is set at an acute angle relative to said axis.

5. A chipper according to claim 3 wherein said deflection surface is positioned radially inwardly of said circumferential surface and at an angle relative to said axis for said deflection surface to deflect said chips in said axial path through said axial face of said drum.

6. A chipper according to claim 1 wherein said chipping member further includes at least one discharge plate mounted for rotation about said axis as said blade moves about said axis, said discharge plate positioned to urge said chips from said axial path toward said chip outlet.

7. A chipper according to claim 6 wherein said discharge plate includes a portion thereof positioned radially away from said axis a distance greater than a radial distance from said axis to said blade.

8. A chipper according to claim 3 wherein said deflection surface includes a generally conical surface disposed within said drum and having a major diameter adjacent said axial face and a minor diameter spaced from said face.

9. A chipper according to claim 4 wherein said angle is selected for a shearing force acting to urge a chip at said deflection surface into motion along said axial path to exceed a friction force opposing said motion.

10. A chipper according to claim 8 including spaced walls defining a pathway from said opening to said conical surface.

11. A chipper according to claim 3 wherein said drum includes a plurality of discharge plates disposed at said axial face.

12. A chipper according to claim 1 wherein said drum includes first and second halves each including a blade and a deflection surface and an axial face wherein chips formed at said blade on said first half are deflected by said deflection surface of said first half through said axial face of said first half and wherein chips formed at said blade on said second half are deflected by said deflection surface of said second half through said axial face of said second half;

said chip outlet positioned to receive chips from said axial faces of both said first and second axial faces.

13. A chipper for chipping wood material including brush and logs, said chipper comprising:

a frame having a material inlet and a chip outlet;

an engine;

a chipping member carried on said frame and including at least one blade mounted in said frame for travel in a circumferential path of travel about an axis of rotation;

said chipping member positioned for said blade to chip said material at said inlet to form chips and with said chips projected in a radial path generally radially inwardly from said blade toward said axis and outwardly in a generally radial path;

said chipping member connected to said engine for said engine to drive said chipping member for said blade to move in said path of travel;

said chip outlet positioned to receive said chips from said axial path;

at least one discharge plate mounted for rotation about said axis as said blade moves about said axis, said discharge plate positioned to urge said chips from said axial path toward said chip outlet.

14. A chipper according to claim 13 wherein said discharge plate includes a portion thereof positioned radially away from said axis a distance greater than a radial distance from said axis to said blade.

15. A chipper for chipping wood material including brush and logs, said chipper comprising:

a frame having a material inlet and a chip outlet;

an engine;

a drum having a circumferential surface and at least a first axial face;

said drum mounted for said circumferential face to oppose said inlet and with said chip outlet at said axial face and with said drum rotatable by said engine about an axis of said drum;

said circumferential surface including at least one opening formed therein and having a blade positioned at said opening to form chips at said opening with said chips passing through said opening in a generally radial path;

means within said drum for directing said chips from said radial path through said axial face.

* * * * *